US005967370A

United States Patent [19]

Nettles et al.

[11] Patent Number: 5,967,370

[45] Date of Patent: Oct. 19, 1999

[54] FUEL BAG KIT HAVING AN INFLATABLE-DEFLATABLE FUEL BAG AND A FUEL BAG STORAGE CONTAINER

[76] Inventors: Jay R. Nettles; Michael C. Nettles, both of 3128 Alicante St., Pensacola, Fla. 32526-2900

[21] Appl. No.: 09/048,970

[22] Filed: Mar. 26, 1998

[51] Int. Cl.[6] ..... B65D 35/56; B67D 5/06; A45C 15/00

[52] U.S. Cl. ..... 222/105; 222/183; 206/38; 206/803

[58] Field of Search ..... 206/218, 38, 803; 222/105, 183

[56] References Cited

U.S. PATENT DOCUMENTS

| | | | |
|---|---|---|---|
| D. 363,215 | 10/1995 | Powell et al. | D9/301 |
| 2,609,549 | 9/1952 | Krupp | 206/803 |
| 2,777,656 | 1/1957 | Clifton | 244/135 |
| 3,182,861 | 5/1965 | Nataf | 222/212 |
| 3,191,810 | 6/1965 | Johnston | 222/183 |
| 4,640,446 | 2/1987 | Walker | 222/416 |
| 4,655,418 | 4/1987 | Melahn | 244/138 R |
| 4,889,255 | 12/1989 | Schiemann | 220/83 |
| 5,195,661 | 3/1993 | Light | 222/105 |
| 5,295,610 | 3/1994 | Levison | 222/26 |
| 5,558,257 | 9/1996 | Braun | 222/212 |

*Primary Examiner*—Andres Kashnikow
*Assistant Examiner*—Keats Quinalty
*Attorney, Agent, or Firm*—Joseph N. Breaux

[57] ABSTRACT

A fuel bag kit comprising a inflatable/deflatable fuel bag for storing fuel therein. The inflatable/deflatable fuel bag comprises a rubber bladder having a deflated/collapsed state to define a deflated/collapsed outer perimeter contour when the rubber bladder is essentially empty and a inflated/expanded state to define a inflated/expanded outer perimeter contour when the rubber bladder is filled with fuel. The deflated/collapsed outer perimeter contour has a significantly thinner width than the inflated/expanded outer perimeter contour. The fuel bag further comprises a nozzle removably coupled to a top end of the rubber bladder and a handle coupled to a bottom end of the rubber bladder. A fuel bag storage container having an outer perimeter contour which is dimensioned smaller than the rubber bladder in the inflated/expanded state and which stores therein the inflatable/deflatable fuel bag when said rubber bladder is in the deflated/collapsed state.

20 Claims, 2 Drawing Sheets

FUEL BAG KIT HAVING AN INFLATABLE-DEFLATABLE FUEL BAG AND A FUEL BAG STORAGE CONTAINER

TECHNICAL FIELD

The present invention relates to containers for fuel and, more particularly, to a fuel bag kit having a inflatable/deflatable fuel bag and a fuel bag storage container for storing therein the inflatable/deflatable fuel bag when such inflatable/deflatable fuel bag is deflated, such as, when the fuel bag is empty. The inflatable/deflatable fuel bag is formed as a rubber bladder wherein the rubber bladder inflates as the fuel fills the rubber bladder and automatically deflates as the fuel is emptied from the rubber bladder. The fuel bag storage container allows the inflatable/deflatable fuel bag, when deflated, to be stored therein to protect the rubber bladder from damage when the inflatable/deflatable fuel bag is not in use and to contain the fuel fumes and fuel residue within such fuel bag storage container.

BACKGROUND OF THE INVENTION

When traveling in a vehicle, there are times when the vehicle runs out of gas. The biggest challenge presented to the driver is the availability of a container which can be filled with fuel. Moreover, the container must have a sufficient capacity of preferably at least one gallon which can be used to start the vehicle and allow the vehicle to travel to the nearest gas station. Another challenge presented to the driver is the ability to pour the fuel into the recessed inlet port of the gas tank without spilling significant portions of the fuel on the ground.

As is known, metal or plastic containers for storing fuel are available. However, many vehicle owners do not maintain such containers within the vehicle. The biggest problem with such metal or plastic containers is that when the container is emptied of the fuel, the fuel residue can drip out and soil the trunk or other floors of the vehicle. Additionally, the fumes of the fuel residue can be very bothersome and problematic.

Furthermore, most containers have walls which have sufficient structural rigidity to define a container capable of being filled to a predetermined maximum capacity such as a gallon. Therefore, these containers are bulky. While plastic or thin metal walls are resilient, as the fluid is depleted, the walls maintain a vertically erect posture and do not naturally converge, without compressive forces, toward each other to reduce the overall volume of the container.

Several devices have been patented which are aimed at fillable containers some of which are directed to containers for fuel.

U.S. Pat. No. 5,558,257, to Bruan, entitled "OVAL INTEGRAL SLANT PUMP" discloses a compressible, resilient, manually-energized pump functioning also as a container or reservoir for fluid products to be dispensed. The container is of a unitary construction in which a product discharge conduit is integrally formed with the reservoir. The container is made of deformable yet resilient plastics composition exhibiting high strength. The container has a bounding, vertically-extending, circumscribing wall which tapers upwardly from an enlarged generally ellipsoid base or floor to a reduced, essentially sound annular shoulder structure which supports a threaded neck. The spout section of the container can function as a mechanical hand-engaging rest or stop to prevent the container from slipping from the grasp of the user.

U.S. Pat. No. 5,295,610, to Levison, entitled "MIXING CAN HAVING A HINGED CAP WITH AN INTEGRAL MEASURING CUP" discloses a plastic gas can having an air-release port and a hinged cap for closing the air-release port. The gas can has an elongated spout from which the gas can be poured and a handle formed in the top region of the gas can.

U.S. Pat. No. 4,889,255, to Schiemann, entitled "DEVICE SUITABLE FOR USE AS A PLASTIC CAN" discloses a plastic can having first and second compartments for placing therein gas and oil. A handle is formed in the top region of the can.

U.S. Pat. No. 4,640,446, to Walker, entitled "SAFETY GAS CAN WITH PLURAL NESTABLE DISPENSING MEANS" disclose a container for gas having one dispensing tube which constitutes a pour spout, while the other dispensing tube constitutes a fuel line coupling member.

U.S. Pat. No. 3,182,661, to Nataf, entitled "BOTTLE MADE OF PLASTIC MATERIAL" discloses a bottle made of plastic material wherein the wall has an extremely small thickness. As disclosed, when the bottle is filled, a spout is closed by welding. The welded spout can be cut to permit fluid to pour from the bottle.

U.S. Design Patent No. Des 363,215, to Powell et al., entitled "CONTAINER" illustrates a unique design for a container.

It can be readily seen that there exists the continuing need for a fuel bag kit having a inflateable/deflateable fuel bag and a fuel bag storage container for storing therein the inflatable/deflatable fuel bag when such inflatable/deflatable fuel bag is deflated, such as, when the fuel bag is empty. Furthermore, the is need for an inflatable/deflatable fuel bag which is formed as a rubber bladder wherein the rubber bladder inflates as the fuel fills the rubber bladder and automatically deflates as the fuel is emptied from the rubber bladder. Additionally, there is a need for a fuel bag storage container which allows the inflatable/deflatable fuel bag when deflated to be stored therein to protect the rubber bladder from damage when the inflatable/deflatable fuel bag is not in use and to contain the fuel fumes and fuel residue within such fuel bag storage container.

As will be seen more fully below, the present invention is substantially different in structure, methodology and approach from that of the prior gas can containers.

SUMMARY OF THE INVENTION

The preferred embodiment of the fuel bag kit of the present invention solves the aforementioned problems in a straight forward and simple manner. What is provided is a fuel bag kit having a inflatable/deflatable fuel bag and a fuel bag storage container for storing therein the inflatable/deflatable fuel bag when such inflatable/deflatable fuel bag is deflated, such as, when the fuel bag is empty. The inflatable/deflatable fuel bag is formed as a rubber bladder wherein the rubber bladder inflates as the fuel fills the rubber bladder and automatically deflates as the fuel is emptied from the rubber bladder. The fuel bag storage container allows the inflatable/deflatable fuel bag, when deflated, to be stored therein to protect the rubber bladder from damage when the inflatable/deflatable fuel bag is not in use and to contain the fuel fumes and fuel residue within such fuel bag storage container.

The inflatable/deflatable fuel bag comprises a rubber bladder having a deflated/collapsed state to define a deflated/collapsed outer perimeter contour when said rubber bladder is essentially empty and an inflated/expanded state to define an inflated/expanded outer perimeter contour when said rubber bladder is filled with fuel wherein said deflated/collapsed outer perimeter contour has a significantly thinner width than the inflated/expanded outer perimeter contour; and a nozzle removably coupled to a top end of said rubber bladder for pouring therefrom said fuel.

The fuel bag storage container has an outer perimeter contour which is dimensioned smaller than said rubber bladder in said inflated/expanded state and which stores therein said inflatable/deflatable fuel bag when said rubber bladder is in said deflated/collapsed state.

In view of the above, an object of the present invention is to provide a fuel bag which is formed as a rubber bladder wherein the rubber bladder includes has a continuous wall structure both longitudinally and circumferentially which is made of an inflatably/deflatably resilient, impermeable material. The inflatably/deflatably resilient, impermeable material lacks structural rigidity. Therefore, the continuous wall structure does not maintain an essentially vertically erect posture or defined outer perimeter contour. However, the inflatably/deflatably resilient, impermeable material serves to allow the collapsed (deflated) continuous wall structure of the rubber bladder to resiliently expand (inflate) outwardly to hold therein the volume of fluid (fuel) filled in the rubber bladder to a predetermined maximum fluid ounce, such as a gallon.

Another feature of the present invention is to provide a rubber bladder made of the inflatably/deflatably resilient, impermeable material which allows the continuous wall structure to further expand (inflate) in the event that the fuel such as, gasoline, produces vapors in warm temperatures.

A further object of the present invention is to provide a rubber bladder made of such inflatably/deflatably resilient, impermeably material which allows the rubber bladder to be squeezed to apply the necessary compression forces to deplete the fuel contents filled in the rubber bladder via a telescopic nozzle. Furthermore, the inflatably/deflatably resilient, impermeably material allows the rubber bladder to be deflated to a point that the rubber bladder is capable of being folded and gathered.

It is a still further object of the present invention to provide a fuel bag which is has a normally deflated/collapsed state when unfilled to reduce the bulkiness of the fuel bag. Thereby, in such deflated/collapsed state, the fuel bag is dimensioned to allow insertion and storage thereof in the fuel bag storage container wherein such fuel bag storage container has a storage capacity significantly less than a gallon.

It is a still further object of the present invention to provide an inflatable/deflatable fuel bag which automatically expands (inflates) to a storage capacity of at least one gallon and, preferably, a capacity of 1 to 1.5 gallons wherein when the rubber bladder of the inflatable/deflatable fuel bag is filled to capacity, the inflatable/deflatable fuel bag is in the inflated/expanded state.

It is a further object of the present invention to provide an inflatable/deflatable fuel bag having a telescopic nozzle which allows the nozzle to be extended for insertion into the recessed inlet port of the gas tank.

It is a still further object of the present invention to provide an inflatable/deflatable fuel bag with a handle coupled to the bottom edge of the rubber bladder which can be used to support the inflatable/deflatable fuel bag in an orientation which would permit the rapid flow of fuel out of the rubber bladder through the telescopic nozzle and into the recessed inlet port of the gas tank.

It is a still further object of the present invention to provide a fuel bag storage container which allows the inflatable/deflatable fuel bag in the deflated/collapsed state to be inserted and stored therein. Thereby, the fuel residue is contained in the fuel bag storage container to prevent drippings of the fuel residue from contaminating any surface in the vehicle.

It is a still further object of the present invention to provide a fuel bag storage container which allows the inflatable/deflatable fuel bag in the deflated/collapsed state to be inserted and stored therein to protect the rubber bladder from being punctured or damaged.

It is a still further object of the present invention to provide a fuel bag storage container which stores the inflatable/deflatable fuel bag therein to contain the fumes of the fuel residue from permeating into the passenger compartment of the vehicle.

It is a still further object of the present invention to provide a fuel bag kit which is compact and can be stored in a glove compartment, if desired.

It is a still further object of the present invention to provide a fuel bag kit which serves to provide the vehicle with a readily available fuel container which can be filled with fuel wherein the inflatable/deflatable fuel bag of the fuel bag kit has a sufficient capacity of at least one gallon which can be used to start the vehicle and allow the vehicle to travel to the nearest gas station.

In view of the above objects, it is a feature of the present invention to provide a fuel bag kit which is simple to manufacture.

Another feature of the present invention is to provide a fuel bag and fuel bag storage container which are relatively simple structurally.

A further feature of the present invention is to provide an inflatable/deflatable fuel bag which is easy to fill fuel therein and pour fuel therefrom.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 3:
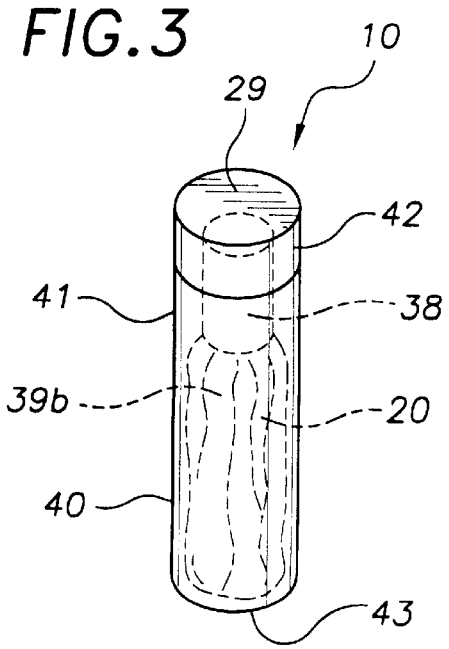

Referring now to the drawings, and in particular FIG. 3, the fuel bag kit of the present invention is designated generally by the numeral 10. Fuel bag kit 10 is comprised of inflatable/deflatable fuel bag 20 and fuel bag storage container 40.

Figure 1:
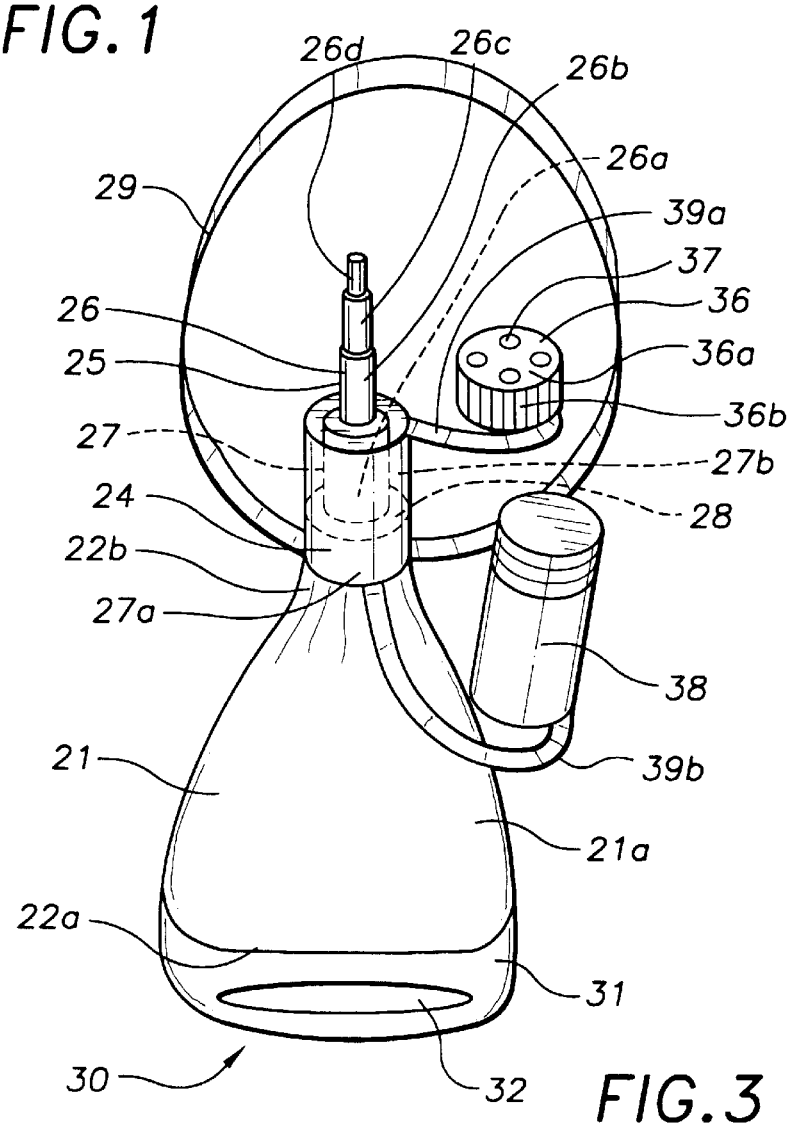
FIG. 1 illustrates a front perspective view of the preferred embodiment of the fuel bag of the present invention with the telescopic nozzle in an extended state.
Figure 2A:
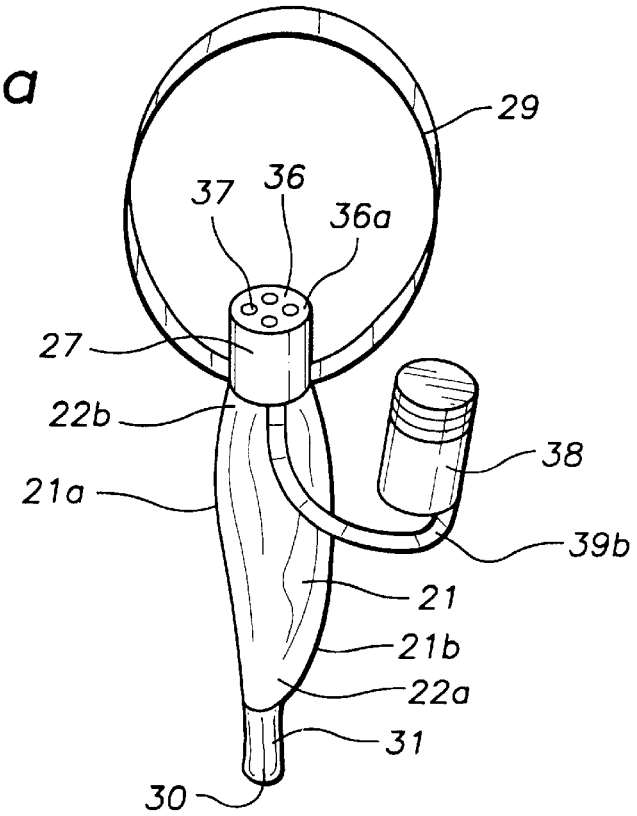
FIG. 2*a* illustrates a side view of the fuel bag in the deflated/collapsed state with the telescopic nozzle in the non-extended state and vented cap member received in the top of the threaded coupler member.
Figure 2B:
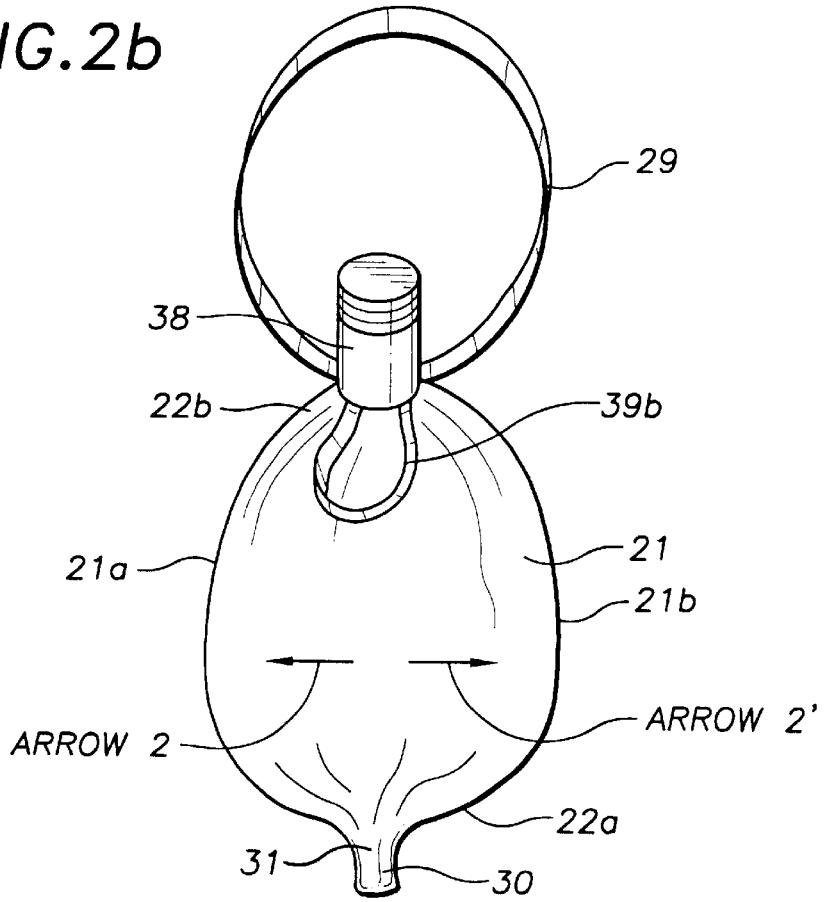
FIG. 2*b* illustrates a side view of the fuel bag in the inflated/expanded state to contain therein at least a gallon with the telescopic nozzle in the non-extended state and the cap means coupled to the threaded coupler member; and, FIG. 3 illustrates a perspective view of the preferred embodiment of the fuel bag storage container of the present invention having the fuel bag stored in the fuel bag storage container.

Referring now to FIGS. 1, 2*a* and 2*b*, inflatable/deflatable fuel bag 20 comprises rubber bladder 21, telescopic nozzle 25, strap member 29, handle 30, and cap means 35. Rubber bladder 21 comprises a continuous wall structure, having front and rear surfaces 21*a* and 21*b*, which is made of inflatably/deflatably resilient, impermeable material. The inflatably/deflatably resilient, impermeable material lacks structural rigidity. Therefore, the continuous wall structure does not maintain an essentially vertically erect posture or a defined outer perimeter contour. The inflatably/deflatably resilient, impermeable material serves to allow front and rear surfaces 21*a* and 21*b* of rubber bladder 21 to resiliently expand outwardly in the directions of ARROWS 2 and 2', as best seen in FIG. 2*b*, to hold therein the volume of fluid filled in rubber bladder 21 to a predetermined maximum fluid ounce. Furthermore, the inflatably/deflatably resilient, impermeable material allows the front and rear surfaces 21*a* and 21*b* to expand in the directions of ARROWS 2 and 2', as best seen in FIG. 2*b*, in the event that the fuel such as, gasoline, produces vapors in warm temperatures.

A can be appreciated, rubber bladder 21 functions similar to a hot water bottle, except that the storage capacity of rubber bladder 21 is at least one gallon and preferably, has a capacity of 1 to 1.5 gallons.

In operation, such inflatably/deflatably resilient, impermeably material allows front and rear surfaces 21*a* and 21*b* of rubber bladder 21 to be easily squeezed to apply the necessary compression forces to deplete the fuel contents filled in rubber bladder 21 via telescopic nozzle 25.

Rubber bladder 21 has a normally deflated/collapsed state, as best seen in FIG. 2*a*, when unfilled to minimize the bulkiness of inflatable/deflatable fuel bag 20 wherein in such deflated/collapsed state inflatable/deflatable fuel bag 20 is dimensioned to allow insertion and storage thereof in fuel bag storage container 40, as best seen in FIG. 3. Furthermore, the inflatably/deflatably resilient, impermeably material allows rubber bladder 21 to be collapsed and folded or gathered, to further reduce the overall size of rubber bladder 21. As can be appreciated, since rubber bladder 21 can be folded or gathered because of the lack of significant structural rigidity in front and rear surfaces 21*a* and 21*b*, the overall dimensions of rubber bladder 21 can be significantly reduced. Henceforth, the dimensions of fuel bag storage container 40 for storing therein rubber bladder, when collapsed and folded or gathered, can be minimized. Thereby, fuel bag kit 10 is compact and can be stored in a glove compartment, if desired. For example, fuel bag kit 10 may be as small as a flashlight housing.

Rubber bladder 21 transitions automatically from an inflated/expanded outer perimeter contour, as best seen in FIG. 2*b*, having a wide width in the inflated/expanded state to said deflated/collapsed outer perimeter contour, as best seen in FIG. 2*a*, having a significantly narrower width in the deflated/collapsed state.

Rubber bladder 21 has closed end 22*a* and open end 22*b*. In the preferred embodiment, open end 22*b* is gathered and has fixedly coupled to such gathered open end 22*b* exteriorly threaded coupler member 24. Thereby, open end 22*b* has a width much smaller than the width of front or rear surfaces 21*a* and 21*b*. While the preferred embodiment, gathers open end 22*b*, alternately, front and rear surfaces 21*a* and 21*b* may be tapered toward open end 22*b*. Exteriorly threaded coupler member 24 has circumferentially formed exteriorly therearound threads.

Telescopic nozzle 25 comprises telescopic spout 26 and interiorly threaded coupler member 27. Interiorly threaded coupler member 27 is a cylindrical member having bottom portion 27*a* and top portion 27*b* separated by circular divider 28. Circular divider 28 has formed in the center thereof an aperture to permit the flow of fuel to flow from rubber bladder 21 and into telescopic spout 26. Bottom portion 27*a* has circumferentially formed interiorly therearound threads which mate with the threads of exteriorly threaded coupler member 24 to couple telescopic nozzle 25 to rubber bladder 21. Top portion 27*b* provides a cavity to house therein telescopic spout 26 when telescopic spout 26 is in the non-extended state.

The bottom rim of interiorly threaded coupler member 27 has fixedly coupled thereto strap member 29 to enable the user to carry inflateable/deflateable fuel bag 20. Strap member 29 has two ends which are coupled to the bottom rim in spaced relation. Strap member 29 allows inflateable/deflateable fuel bag 20 to be supported by the user such that open end 22*b* is maintained in an upright position.

Telescopic spout 26 comprises base 26*a*which is fixedly coupled to circular divider 28 around the aperture (not shown) formed therein. In the exemplary embodiment, telescopic spout 26 also has three members 26*b*, 26*c* and 26*d* which are telescopingly engaged in a watertight manner wherein telescopic spout 26 has a non-extended state and an extended state. The extended state is best seen in FIG. 1. When inflateable/deflateable fuel bag is not in use, telescopic spout 26 is placed in the non-extended state wherein in such non-extended state, telescopic spout 26 is fully received in the cavity provided by top portion 27*b* of interiorly threaded coupler member 27. In order to transfer the fuel contained in rubber bladder 21 into a recessed inlet port of the gas tank, telescopic spout 26 is telescopingly extended into the extended state and then inserted into the recessed inlet port of the gas tank.

When filling rubber bladder 21, interiorly threaded coupler member 27 of telescopic nozzle 25 is removed from exteriorly threaded coupler member 24 of rubber bladder 21. The nozzle (not shown) of the gas pump is inserted into the opening of exteriorly threaded coupler member 24. Thereafter, fuel is filled into rubber bladder 21 until at least one gallon is measured. However, if rubber bladder 21 has the capacity to hold more than a gallon of fuel more fuel may be filled to the predetermined maximum fluid ounce. After, the fuel has been filled, the nozzle (not shown) of the gas pump is removed and interiorly threaded coupler member 27 of telescopic nozzle 25 is screwed onto exteriorly threaded coupler member 24 of rubber bladder 21.

As can be appreciated, the diameter of the opening in exteriorly threaded coupler member 24 of rubber bladder 21 is much larger than the opening provided by telescopic spout 26. The narrowed opening of telescopic spout 26 to define an outlet serves to control the flow of fuel to minimize, if not eliminate, spillage of the fuel. Moreover, as compressive forces are exerted to squeeze rubber bladder 21, the fuel exiting through the narrowed opening of telescopic spout 26 is in the form of a stream of fuel which is injected into the gas tank.

Front and rear surfaces 21*a* and 21*b* of rubber bladder 21 are sealed at closed end 22*a* of rubber bladder 21. Extending from closed end 22*a* is extension member 31 having formed therein an elongated slot 32 for placing the user's hand therethrough. Extension member 31 having elongated slot 32 creates handle 30. Handle 30 enables the user to support rubber bladder 21 in an orientation which would permit the rapid flow of the fuel out of rubber bladder 21 through the telescopic spout 26 and into the recessed inlet port of the gas tank. Such orientation requires rubber bladder 21 to be oriented such that handle 30 is disposed above open end 22*b*. Thereby, gravitational forces would allow the fuel to flow out of telescopic spout 26 and into the recessed inlet port of the gas tank.

Cap means 35 comprises vented cap member 36 and slidable cap member 38 wherein vented cap member 36 and slidable cap member 38 are hingely coupled to interiorly threaded coupler member 27. Vented cap member 36 is removably coupled in top portion 27*b* of interiorly threaded coupler member 27. The top surface 36*a* of vented cap member 36 has formed therein a plurality of vent holes 37. The circumferential outer surface 36*b* has formed therealong ridges. Vented cap member 36 is hingely coupled via flexible hinge 39*a* to the top rim of interiorly threaded coupler member 27 to facilitate the removal of vented cap member 36 when received in top portion 27*b*. Furthermore, flexible hinge 39*b* serves to prevent vented cap member 36 from becoming disassociated from inflatable/deflatable fuel bag 20.

Slidable cap member 38 is removably coupled slibably along an outer surface of interiorly threaded coupler member 27. Slidable cap member 38 is hingely coupled via flexible hinge 39*b* to the bottom rim of interiorly threaded coupler member 27 to prevent slidable cap member 38 from becoming disassociated from inflatable/deflatable fuel bag 20.

Referring now to FIG. 3, fuel bag storage container 40 comprises tubular housing member 41 and lid member 42. Tubular housing member 41 has one end fixedly closed via bottom wall 43. The other end of tubular housing member 41 is threaded (not shown) to matingly couple with threads of lid member 42. In the exemplary embodiment, as shown in FIG. 4, the diameter of tubular housing member 41 is slightly greater than the diameter of exteriorly threaded coupler member 27 of telescopic nozzle 25 to provide sufficient clearance for the insertion of inflatable/deflatable fuel bag 20. Moreover, the length of tubular housing member 41 is less than the length of inflatable/deflatable fuel bag 21. The inflatably/deflatably resilient, impermeable material of rubber bladder 21 allows rubber bladder 21 to be bundled within tubular housing member 41 without compromising the structural integrity of rubber bladder 21.

The outer perimeter contour. Oft fuel bag storage container 40 is sufficient to store therein the inflatable/deflatable fuel bag in the deflated/collapsed state only or when the inflatable/deflatable fuel bag 20 is significantly empty. Thereby, after the fuel has be significantly depleted from inflatable/deflatable fuel bag 20, any fuel residue from inflatable/deflatable fuel bag 20 is contained in fuel bag storage container 40 to prevent drippings of the fuel residue from contaminating any surface in the vehicle. Additionally, fuel bag storage container 40 contain the fumes (vapor) of the fuel residue from permeating into the passenger compartment of the vehicle. Moreover, fuel bag storage container 40 allows inflatable/deflatable fuel bag in the deflated/collapsed state to be inserted and stored therein to protect rubber bladder 21 from being punctured or damaged.

While the exemplary embodiment illustrates a tubular outer perimeter contour for fuel bag storage container 40, fuel bag storage container 40 may have any desired outer perimeter contour provided such outer perimeter contour is dimensioned to store inflatable/deflatable fuel bag 20 in the deflated/collapsed state only.

In the preferred embodiment, fuel bag storage container 40 is made of a rigid plastic, metal or other material which allows fuel bag storage container to maintain a vertically erect posture and a defined outer perimeter contour.

As can be readily seen, fuel bag kit 10 serves to provide a vehicle with a readily available fuel container which can be filled with fuel wherein the inflatable/deflatable fuel bag 20 of the fuel bag kit 10 has a sufficient capacity of at least one gallon which can be used to start the vehicle and allow the vehicle to travel to the nearest gas station.

It is noted that the embodiment of the fuel bag kit described herein in detail, for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A fuel bag kit comprising:

a inflatable/deflatable fuel bag for storing therein fuel wherein said inflatable/deflatable fuel bag comprises:

a rubber bladder having a deflated/collapsed state to define a deflated/collapsed outer perimeter contour when said rubber bladder is essentially empty and a inflated/expanded state to define a inflated/expanded outer perimeter contour when said rubber bladder is filled with fuel wherein said deflated/collapsed outer perimeter contour has a significantly thinner width than the inflated/expanded outer perimeter contour, and a nozzle removably coupled to a top end of said rubber bladder for pouring therefrom said fuel; and, a fuel bag storage container having an outer perimeter contour which is dimensioned smaller than said rubber bladder in said inflated/expanded state and which stores therein said inflatable/deflatable fuel bag when said rubber bladder is in said deflated/collapsed state.

2. The fuel bag kit of claim 1, wherein as said rubber bladder transitions automatically from said inflated/expanded outer perimeter contour having a capacity of at least one gallon to said deflated/collapsed outer perimeter contour.

3. The fuel bag kit of claim 1, wherein said rubber bladder has a continuous wall structure made of inflatably/deflatably resilient, impermeable material which does not maintain a vertically erect posture or a defined outer perimeter contour.

4. The fuel bag kit of claim 1, wherein said rubber bladder has continuous wall structure which forms an enclosure having a bottom closed end wherein said rubber bladder comprises:

a first threaded coupler member fixedly coupled to said top end;

wherein said nozzle comprises:

a second threaded coupler member couplable to said threaded coupler member of said rubber bladder; and, a telescopic spout coupled to said second threaded coupler member;

and wherein said fuel bag further comprises:

a handle coupled to said bottom closed end of said rubber bladder.

5. The fuel bag kit of claim 4, wherein said fuel bag further comprises a strap member having a first end and a second end which are coupled in space relation to a bottom rim of said second threaded coupler member.

6. The fuel bag kit of claim 4, wherein said fuel bag storage container comprises:

a tubular housing member having an open top end wherein said tubular housing member has a defined outer perimeter contour defined by a diameter slightly greater than a diameter of said second threaded coupler member of said inflatable/deflatable fuel bag to provide sufficient clearance for the insertion of said inflatable/deflatable fuel bag when said inflatable/deflatable fuel bag is in said deflated/collapsed state; and a lid member for closing said open top end of said tubular housing member.

7. The fuel bag kit of claim 4, wherein said second threaded coupler member comprises a bottom portion and a top portion divided by a divider wherein said bottom portion is matingly coupled to said first threaded coupler member and said telescopic nozzle is coupled to said divider and wherein said top portion fully houses therein said telescopic spout when said telescopic spout is in a non-extended state and when said telescopic spout is in said extended state the length of said telescopic spout is increased beyond said top portion.

8. The fuel bag kit of claim 4, wherein said inflatable/deflatable fuel bag further comprises:

a cap means removably coupled to said second threaded coupler member for enclosing a top portion of said second threaded coupling member.

9. The fuel bag kit of claim 1, wherein said inflatable/deflatable fuel bag further comprises:

a vented cap member removably coupled in said top portion of said second threaded coupler member wherein said vented cap member has a top surface having formed therein a plurality of vent holes; and a slidable cap member removably coupled slibably to an outer surface of said second threaded coupler member.

10. The fuel bag kit of claim 9, wherein said vented cap member comprises:

a hinge member for hingely coupling said vented cap member to a top rim of said second threaded coupler member;

and wherein said slidable cap member comprises:

a hinge member for hingely coupling said slidable cap member to a bottom rim of said second threaded coupler member.

11. A fuel bag kit comprising:

a inflatable/deflatable fuel bag for storing therein fuel wherein said inflatable/deflatable fuel bag comprises:

a rubber bladder having a deflated/collapsed state to define a deflated/collapsed outer perimeter contour having a narrow width when said rubber bladder is essentially empty and an inflated/expanded state to define a inflated/expanded outer perimeter contour having a wide width when said rubber bladder is filled with fuel wherein said rubber bladder automatically transitions to said deflated/collapsed outer perimeter contour from the inflated/expanded outer perimeter contour, a handle coupled to a bottom end of said rubber bladder, and a nozzle removably coupled to a top end of said rubber bladder for pouring therefrom said fuel; and, a fuel bag storage container having an outer perimeter contour which is dimensioned smaller than said rubber bladder in said inflated/expanded state and which stores therein said inflatable/deflatable fuel bag when said rubber bladder is in said deflated/collapsed state.

12. The fuel bag kit of claim 11, wherein said inflated/expanded outer perimeter contour has a capacity of at least one gallon.

13. The fuel bag kit of claim 11, wherein said rubber bladder has a continuous wall structure made of inflatably/deflatably resilient, impermeable material which does not maintain a vertically erect posture or a defined outer perimeter contour.

14. The fuel bag kit of claim 11, wherein said fuel bag further comprises a strap member for carrying said inflatable/deflatable fuel bag.

15. The fuel bag kit of claim 11, wherein said rubber bladder has continuous wall structure which forms an enclosure having a bottom closed end wherein said rubber bladder comprises:

a first threaded coupler member fixedly coupled to said top end;

wherein said nozzle comprises:

a second threaded coupler member couplable to said threaded coupler member of said rubber bladder; and, a telescopic spout coupled to said second threaded coupler member.

16. The fuel bag kit of claim 15, wherein said fuel bag storage container comprises:

a tubular housing member having an open top end wherein said tubular housing member has a defined outer perimeter contour defined by a diameter slightly greater than a diameter of said second threaded coupler member of said inflatable/deflatable fuel bag to provide sufficient clearance for the insertion of said inflatable/deflatable fuel bag when said inflatable/deflatable fuel bag is in said deflated/collapsed state; and a lid member for closing said open top end of said tubular housing member.

17. The fuel bag kit of claim 15, wherein said second threaded coupler member comprises a bottom portion and a top portion divided by a divider wherein said bottom portion is matingly coupled to said first threaded coupler member and said telescopic nozzle is coupled to said divider and wherein said top portion fully houses therein said telescopic spout when said telescopic spout is in a non-extended state and when said telescopic spout is in said extended state the length of said telescopic spout is increased beyond said top portion.

18. The fuel bag kit of claim 15, wherein said inflatable/deflatable fuel bag further comprises:

a cap means removably coupled to said second threaded coupler member for enclosing a top portion of said second threaded coupling member.

19. The fuel bag kit of claim 11, wherein said inflatable/deflatable fuel bag further comprises:

a vented cap member removably coupled in said top portion of said second threaded coupler member wherein said vented cap member has a top surface having formed therein a plurality of vent holes; and a slidable cap member removably coupled slibably to an outer surface of said second threaded coupler member.

20. The fuel bag kit of claim 19, wherein said vented cap member comprises:

a hinge member for hingely coupling said vented cap member to a top rim of said second threaded coupler member;

and wherein said slidable cap member comprises:

a hinge member for hingely coupling said slidable cap member to a bottom rim of said second threaded coupler member.

* * * * *